United States Patent [19]

Trkla

[11] Patent Number: 4,949,408

[45] Date of Patent: Aug. 21, 1990

[54] ALL PURPOSE WHEELCHAIR

[76] Inventor: Theodore A. Trkla, 205 Ninth St. So., So. St. Paul, Minn. 55075

[21] Appl. No.: 414,753

[22] Filed: Sep. 29, 1989

[51] Int. Cl.[5] ..... A61G 7/06

[52] U.S. Cl. ..... 5/86; 5/68; 5/508; 297/DIG. 4

[58] Field of Search ..... 5/66, 68, 80, 81 R, 5/86, 445, 503, 508; 297/417, 434, 435, DIG. 4; 280/309.1

[56] References Cited

U.S. PATENT DOCUMENTS

| | | | |
|---|---|---|---|
| 2,798,565 | 7/1957 | Rosenthal et al. | 297/DIG. 4 X |
| 3,038,174 | 6/1962 | Brown et al. | 5/68 X |
| 3,495,869 | 2/1970 | Ingemansson | 5/81 R X |
| 3,807,520 | 4/1974 | Chisholm | 297/DIG. 4 X |
| 3,883,175 | 5/1975 | Rodaway | 297/417 X |
| 3,964,786 | 6/1976 | Mashuda | 297/DIG. 4 X |
| 4,193,147 | 3/1980 | Fischer | 5/86 X |
| 4,333,681 | 6/1982 | Nelson . | |
| 4,343,482 | 8/1982 | Wegner . | |
| 4,514,867 | 5/1985 | Jensen . | |
| 4,565,385 | 1/1986 | Morford | 297/DIG. 4 X |
| 4,591,182 | 5/1986 | Wood | 297/DIG. 4 X |
| 4,592,562 | 6/1986 | Strautnieks et al. . | |
| 4,614,246 | 9/1986 | Masse et al. | 297/DiG. 4 X |
| 4,679,259 | 7/1987 | DiMatteo et al. . | |
| 4,691,962 | 9/1987 | Holdt . | |
| 4,700,415 | 10/1987 | DeMatteo et al. . | |
| 4,717,169 | 1/1988 | Shaffer . | |
| 4,759,561 | 7/1988 | Janssen . | |
| 4,759,562 | 7/1988 | Vinyard et al. . | |
| 4,862,529 | 9/1989 | Peck | 5/68 X |

FOREIGN PATENT DOCUMENTS

| | | | |
|---|---|---|---|
| 2517418 | 11/1976 | Fed. Rep. of Germany | 297/DIG. 4 |
| 2125285 | 3/1984 | United Kingdom | 297/DIG. 4 X |

*Primary Examiner*—Michael F. Trettel
*Attorney, Agent, or Firm*—Jacobson & Johnson

[57] ABSTRACT

An all purpose self powered wheelchair that permits the user to become self sufficient by permitting the user to move about, relieve themselves of bodily wastes, change their own bedpan, exercise, receive intravenous transfer of fluids, change positions, and also permits a person to assist the wheelchair user in transferring the wheelchair user from a bed to a wheelchair or from a wheelchair to a bed without the person having to lift the wheelchair user.

18 Claims, 7 Drawing Sheets

ALL PURPOSE WHEELCHAIR

FIELD OF THE INVENTION

This invention relates generally to wheelchairs and, more specifically, to a wheelchair that permits the user to be self sufficient and folds flat like a gurney to permit the user to be easily transferred between a bed and the wheelchair.

DESCRIPTION OF THE PRIOR ART

The 1988 Vinyard et al. U.S. Pat. No. 4,759,562 shows a walker that converts into a wheelchair.

The 1988 Janssen U.S. Pat. No. 4,759,561 shows a wheelchair with tiltable mechanism that allows the user to tilt the entire seating mechanism without any change in stability in the wheelchair.

The 1988 Shaffer U.S. Pat. No. 4,717,169 shows a convertible bed and wheelchair that has mattress like cushions so the wheelchair can be converted into a comfortable bed.

The 1987 DiMatteo et al. U.S. Pat. No. 4,679,259 shows a reclineable wheelchair that has a lengthwise endless belt that can be laid flat and used to transport the person to and from a bed.

The 1987 DiMatteo et al. U.S. Pat. No. 4,700,415 shows a reclineable wheelchair that has a lateral set of endless belts to transport a person to and from a bed.

The 1987 Holdt U.S. Pat. No. 4,691,962 shows a convertible wheelchair/litter with a pivotal legrest, a pivotal backrest, and a quick release mechanisms to permit the cushions to be changed.

The 1986 Strautnieks et al. U.S. Pat. No. 4,592,562 shows a wheelchair transfer device with a pivotable legrest, a swivel post with an automotive type hydraulic jack that permits a person to raise the user so the user can be positioned angularly and vertically by a helper.

The 1985 Jensen U.S. Pat. No. 4,514,867 shows a seat construction that permits the user to use a toilet without being removed from the wheelchair. The wheelchair uses a manually pivotable center section that can be pivoted downward so that the user can back the wheelchair over a toilet.

The 1982 Nelson U.S. Pat. No. 4,333,681 shows a power wheelchair with a pivoting footrest and a tilting back that provides coordinated movement between the seat assembly, the backrest assembly, and the foot rest assembly to prevent shearing of the users skin during the tilting motions.

The 1982 Wegner U.S. Pat. No. 4,343,482 shows a fully collapsible wheelchair that permits handicapped persons to use a toilet seat without having to be removed from the chair.

BACKGROUND OF THE INVENTION

The prior art is replete with wheelchair type devices that perform numerous functions. The present invention provides an improvement to the prior art devices by providing a powered wheelchair that permits the user to convert the wheelchair support surfaces from a conventional chair position to a horizontal bed position while at the same time permitting the user to elevate the wheelchair support surfaces to the level of a bed so the user can be transferred to a bed without having to be lifted. Other features of the wheelchair make it suitable for the user to exercise, go to the toilet, move about, or receive i.v. injections from the wheelchair.

One of the problems with transfer of users from wheelchairs to beds or vice versa is that it is time consuming and stressful to both the users body and the attendants body to transfer a user to and from a wheelchair. The present invention provides an adjustable support surface to permit easy transfer method.

The present invention through electro-mechanically means moves the user to a sitting position for commode use or easy chair comfort. The motorized wheelchair permits disabled people to be unattended for extended periods of time since once transferred onto the wheelchair the user can move about the home to eat, watch television, relieve themselves of bodily wastes, empty their own bedpan and even recline the chair into a comfortable bed for a nap.

When powered by an electric storage battery and linear actuators the footrest can be raised up, level with the seat, and the backrest can be reclined, to make the entire wheelchair support surfaces flat like a gurney. The vertical position of the support surfaces can be adjusted to permit the easy transfer of the user from the wheelchair to a bed or back again.

SUMMARY OF THE INVENTION

Briefly, the present invention comprises a self powered wheelchair that permits the user to become self sufficient by permitting the user to move about, relieve themselves of bodily wastes, change their own bedpan, exercise, receive intravenous transfer of fluids, change positions, and also permits a person to assist the user in transferring the user from a bed to a wheelchair or from a wheelchair to a bed without the person having to lift the user.

DESCRIPTION OF THE PREFERRED EMBODIMENT

Figure 1:
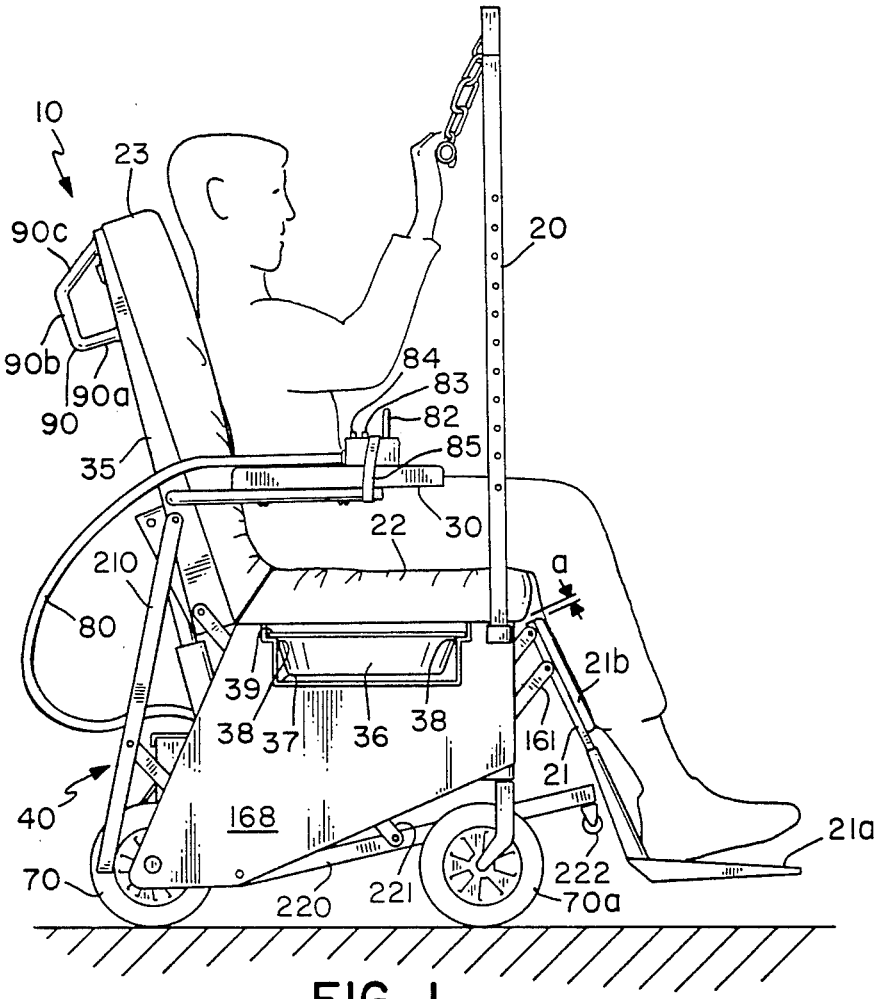
FIG. 1 shows a side view of a user exercising in my wheelchair.
Figure 4:
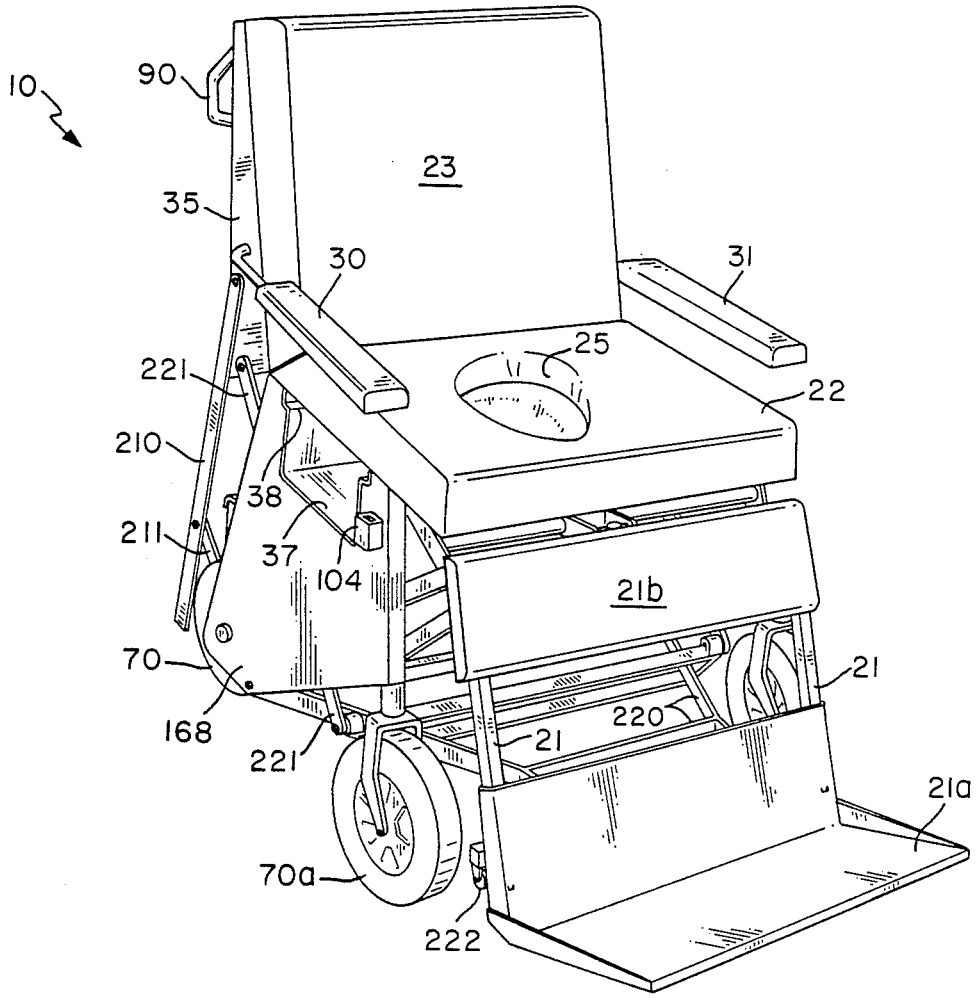
FIG. 4 shows a pictorial view of my wheelchair.

Referring to FIG. 1 reference numeral 10 generally identifies my wheelchair with a user sitting up and exercising with an exercise bar 20. FIG. 4 shows my wheelchair unoccupied and with exercise bar 20 removed.

Referring to FIG. 1 and FIG. 4 my wheelchair 10 includes a frame 19, a seat cushion 22, a pivotable backrest frame 35, a backrest cushion 23, and a pivotable and extendable legrest 21 that has a leg support panel **21*b* and a footrest 21*a*. Located on the side of the wheelchair and pivotable and retractable connected to backrest frame 35 is a first armrest 30** and a second armrest 31. Located below seat cushion 22 is a bedpan 36 that is slidable mounted in an elongated compartment 37 that extends crosswise below cushion 22. A pair of recessed lips 38 and 39 support bedpan 36 in a suspended condition over the opening 25 in cushion 22. Compartment 37 is made of metal and permits and collects any accidental spillage from use of bedpan 36.

Figure 2:
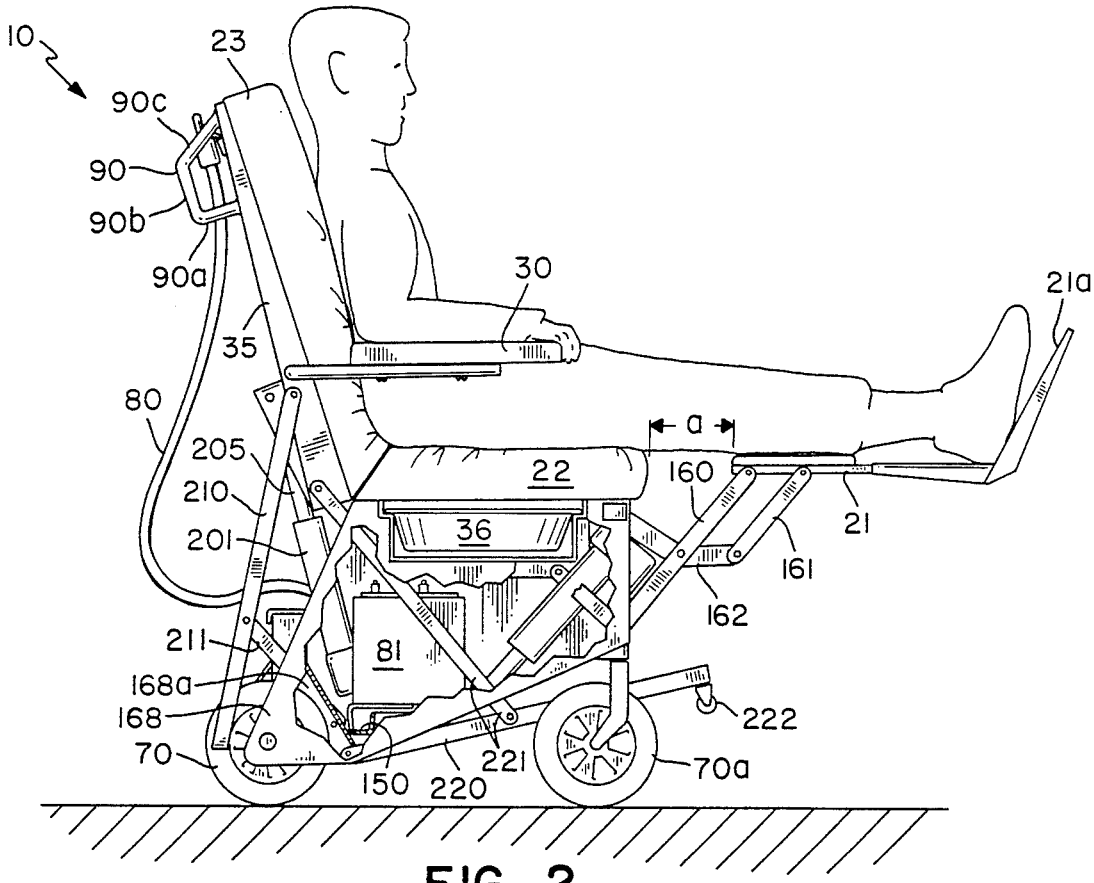
FIG.2 shows a side view of a user with the feet elevated by my extendable foot rest.
Figure 3:
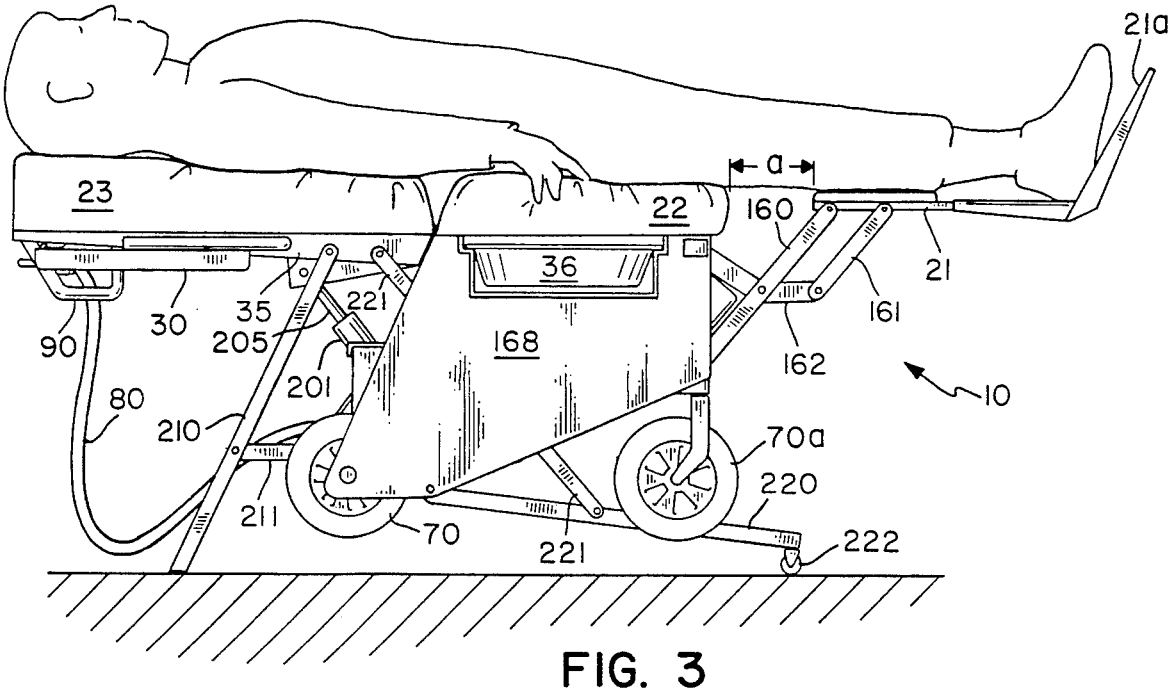
FIG. 3 shows a side view of a user laying horizontally on my wheelchair with the wheelchair elevated to permit the user to transfer to a bed.

To illustrate the basic motions provided by wheelchair 10 reference should be made to FIG. 1, FIG. 2, and FIG. 3. FIG. 1 shows the wheelchair in the chair position with a user in the vertical sitting position while FIG. 2 shows a user in the vertical sitting position with the feet elevated by legrest 21. FIG. 3 shows the user in a horizontal position with the users body elevated from the floor.

A feature of the invention is that the legrest 21 includes a scissor support mechanism that both pivots and extends as legrest 21 is raised from the vertical to the horizontal position. A reference to FIG. 1 shows legrest 21 in the vertical position and FIG. 2 shows the legrest 21 in the extended horizontal position. Note that the top of the legrest when raised from the vertical to the horizontal position has been horizonatally displaced a distance denoted by "a" which in FIG. 2 is several inches longer then the dimension a in FIG. 1. The use of a pivotable and extendable legrest permits the legrest to follow the natural pivoting action of the users leg. That is the the pivot point of the knee and the legrest are not in the same vertical plane. Consequently, the pivoting of the legrest from the vertical to the horizontal position places an upward force on the users legs. The present invention by virtue of a scissor linkage permits the legrest to be extended outward away from the body to compensate for the lack of a common pivot plane for the knee and the legrest. FIG. 1 and FIG. 2 illustrate this feature of the extending of the legrest as the legrest is elevated.

Another feature of my invention is my lifting mechanism 40 that permits wheelchair 10 to be converted from the sitting or chair position to a vertically positionable horizontal position or gurney as shown in FIG. 3. Lifting mechanism 40 connects to the backrest frame 35 and to a linear servo motor 201 that permits one to raise or lower wheelchair 10 so that the user can vertically position himself or herself at the same vertical height as a bed. Thus one feature of the present invention is the ability of the user to go from the sitting position to the horizontal position where the user can roll onto a bed. In cases where the user does not have sufficient strength to move onto a bed an assistant can help move the user from the wheelchair to the bed without having to lift the person.

Figure 5:
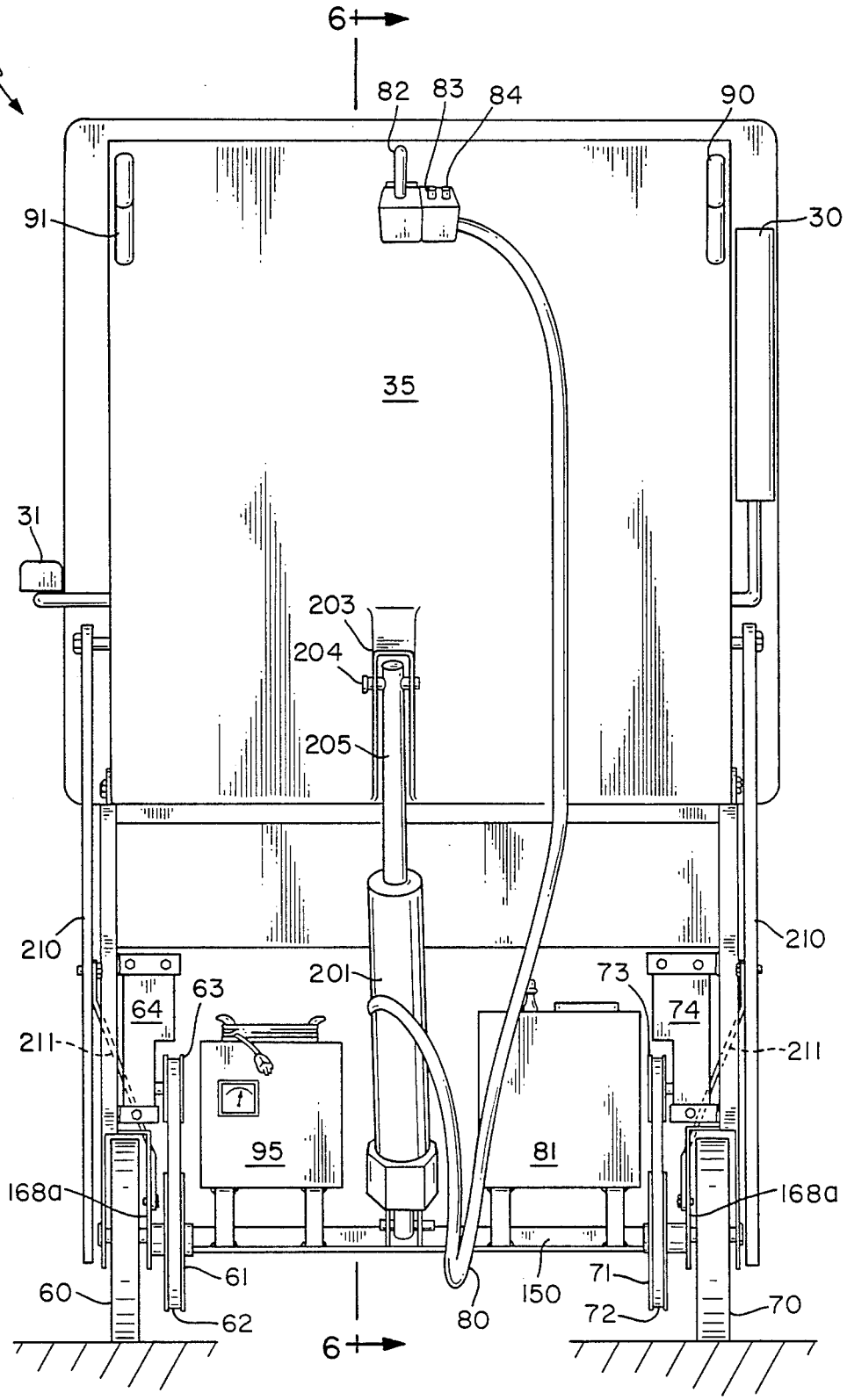
FIG. 5 shows a rear elevation view of my wheelchair.

In order for my wheelchair to be vertically positioned in a horizontally extending abutting relationship to a bed I provide my wheelchair with pivotable and retractable armrests 30 and 31. FIG. 4 shows my armrests in the normal position. FIG. 3 shows armrest 30 in the retracted position. A reference to FIG. 5 shows armrest 31 in the normal position and armrest 30 in the retracted position. In the retracted position armrest 30 has been pivoted backward and displaced inwardly so that armrest 30 is located behind backrest cushion 23. With armrest 30 behind cushion 23 it is apparent that the cushion 23 can be abutted against the side of a bed to facilitate transfer of a user from my wheelchair to a bed.

Figure 7:
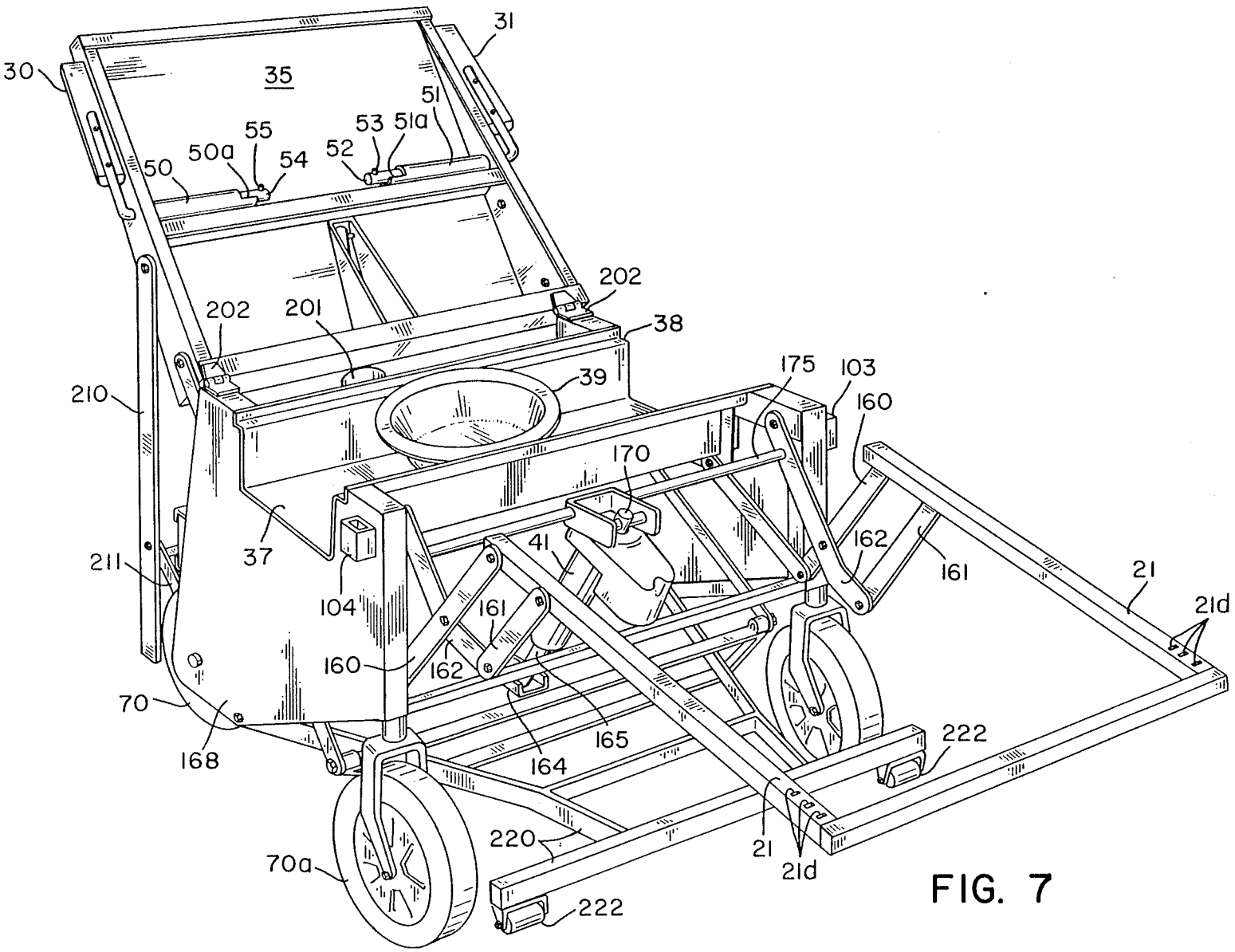
FIG. 7 shows a pictorial view with the cushions removed to reveal the linkage mechanisms.

The mechanism for permitting pivoting and inward displacement of armrests 30 and 31 is shown more clearly in FIG. 7 which reveals my wheelchair without the support cushions. FIG. 7 shows a cylindrical sleeve 50 that rotatable and slidable supports cylindrical member 54. A pin 55 extends through member 54 to prevent member 54 from being withdrawn from cylindrical support member 50. Pin 55 also acts as a stop to engage notch 50*a* so that when armrest 30 is pivoted to the normal horizontal position the pin 55 engages notch 50*a* and thus supports armrest 30 in the horizontal extended position as shown in FIG. 1 and FIG. 2. Similarly, armrest 31 includes a cylindrical housing 51 and a cylindrical rod with a pin 53. Since the operation of armrest 31 is identical to armrest 30 it will not be described.

My wheelchair 10 includes means for propelling the wheelchair about on a horizontal surface. Reference to FIG. 5 shows that rear wheel 60 connects to a drive pulley 61 which is powered by a drive motor 64 through a pulley 63 and drive belt 62. Similarly, located on the other side of wheelchair 10 is a rear drive wheel 70 that connects to a drive pulley 71 which is powered by a drive motor 74 through a pulley 73 and drive belt 72. Both drive motor 64 and drive motor 74 are powered by electric storage battery 81 and are controlled by the user through a joystick 82 that is held on armrest 30 by a band fastener 85.

Wheelchair 10 includes a positionable control module for controlling both the position of the support surfaces and the motion of my wheelchair 10. The controls for motor 64 and 74 are provided to the user through an umbilical electrical cord 80 that connects to electric storage battery 81 for supplying electrical power to the motors and to the linear actuators for operating the mechanisms for controlling the operation of the wheelchair. The control module includes three controls, a joy stick control 82 for controlling the movement of the wheelchair, a first switch 83 for controlling the actuator that lifts the legrest and a second switch 84 for controlling the actuator that tilts the backrest and elevates the wheelchair.

The control module with the switches can either be attached to armrest 30 with a member 85 as shown in FIG. 1 or can be attached to the backrest frame 35 as shown in FIG. 5. If a user has control of their upper body functions the control module can be mounted on the armrest so the user can have complete control of all the wheelchair motions. If the user is not able to control the movement of the wheelchair the control module can be mounted on back frame 35 so that a person assisting the user can have easy access to the controls.

One feature of my wheelchair is the pair of multiple angle handgrips 90 and 91 that are attached to backrest frame 35. The handgrips are for the purpose of permitting a person who may be assisting the wheelchair user to move or position the wheelchair. Since both the handgrips are identical only one will be described. FIG. 1 shows handgrip 90 connected to the top portion of backrest frame 30. Handgrip 90 contains a first section 90*a* that extends perpendicular from backrest frame 35, a second section 90*b* that is parallel to backrest frame 35, and a third section 90*c* that is at approximately at 45 degree angle to backrest frame 35. The purpose of having handgrip section 90*c* at an angle of approximately 45 degrees is that it provides a more convenient grasping position when the backrest is not in the vertical position. Consequently, the combination of the handgrip having surfaces located parallel, horizontal and at a 45 degree angle to the backrest frame insures that a person who is assisting the person in the wheelchair may have a convenient grasping angle for grasping the handgrips and positioning the wheelchair as necessary.

My wheelchair includes a battery charger 95 (FIG.5) to permit the user to charge the battery when the battery becomes run down.

Figure 8:
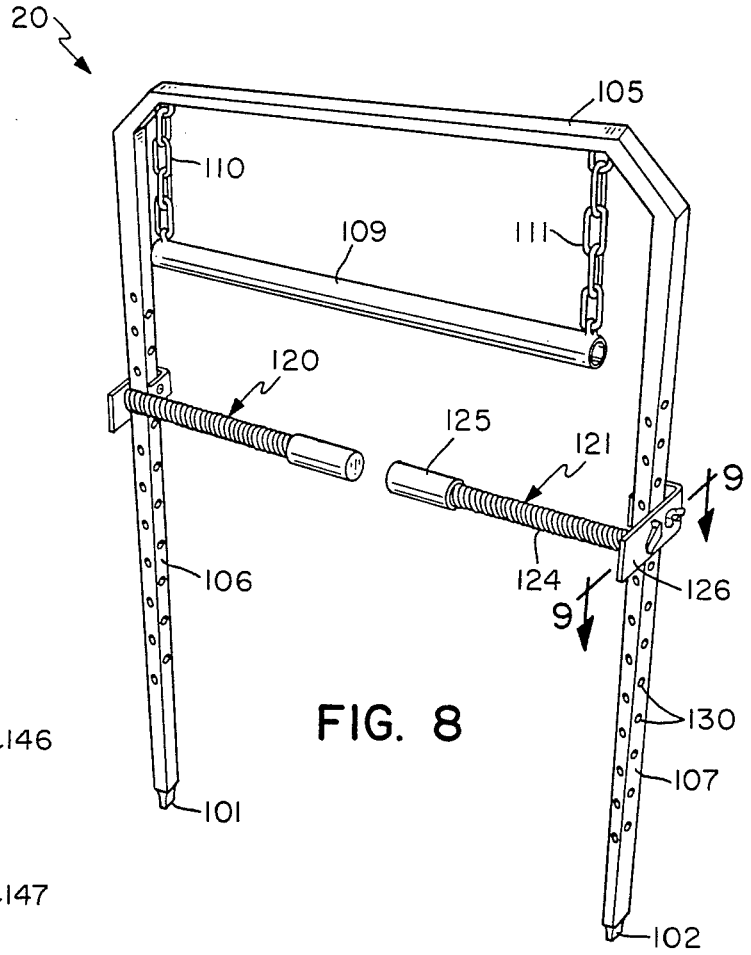
FIG. 8 shows an exercise bar for use with my wheelchair.

Referring to FIG. 8 my exercise bar 20 is shown in greater detail. Exercise bar 20 contains a first end 101 for fitting into a side socket 104 (FIG. 7) on one side of wheelchair 10. Similarly, exercise bar 20 contains a second end 102 that fits into a side socket 103 (FIG.7) on the opposite side of wheelchair 10. Exercise bar 120 has a general U-shape with a top cross member 105 and a first vertical member 106 and a second vertical member 107 connected to cross member 105.

Extending downward from cross member 105 is a trapeze bar 109 that is connected to bar 105 by a first chain 110 and a second chain 111. Chains 110 and 11 include links that can be added or removed thus making trapeze bar 109 vertically positionable with respect to a user sitting in wheelchair 10. Trapeze bar 109 permits the user to lift himself or herself upward in wheelchair 10.

Figure 9:
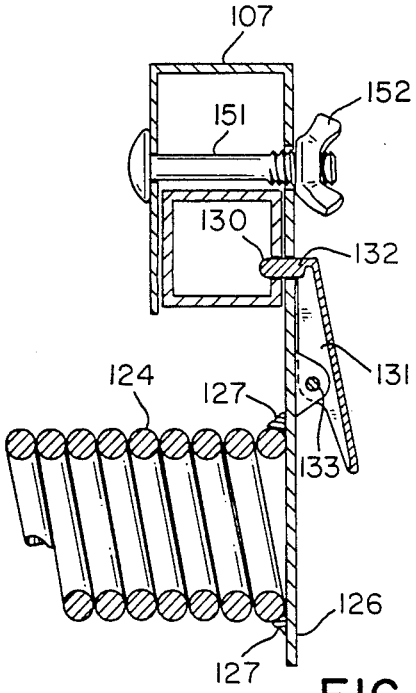
FIG. 9 shows a sectional view of my positionable hand exerciser that mounts on my exercise bar.

Located extending laterally from the side of exercise bar 20 are vertically and rotationable positionable hand exercisers 120 and 121. Since the positionable hand exerciser 120 is a mirror image of hand exerciser 121 only one will be described. Referring to FIG. 8 and FIG. 9 hand exerciser 121 includes a coil spring 124 that has a handgrip 125 on one end. The opposite end of coil spring 124 is fastened to member 126 through weld 127 or the like. An inspection of side member 107 shows that there are holes 130 located in the faces of member 107. FIG. 9 shows that holes 130 act as stops for the pivot latch 131 that pivots about pivot pin 133 to permit the cylindrical plug 132 to extend through the opening 130 in member 107. Thus it will be envisioned the plug 132 prevents vertical or horizontal displacement of member 126 and exerciser 121. In order to lock exerciser 121 in place I provide a bolt 151 that has a wingnut 152 to permit the user to tighten the U-shaped end of member 126 about member 107.

To vertically position my exerciser 121 I can retract plug 130 and loosen nut 141 to permit exerciser 121 to be vertically positioned in the openings 130 in member 107. Also since member 107 contains openings on each of the faces it permits one to rotationally position exercise bar 121 in any of four different rotational orientations with respect to member 107.

Figure 10:
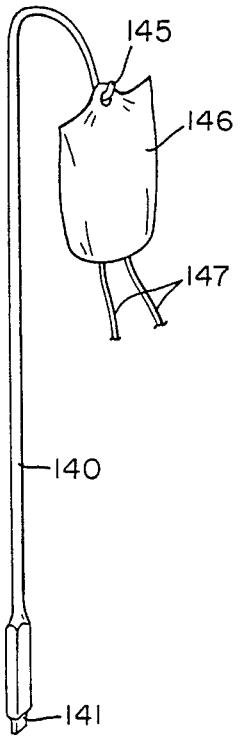
FIG. 10 shows an i.v. attachment and i.v. bag for use with my wheelchair.

Referring to FIG. 10 there is shown an intravenous attachment member 140 that has end 141 which can be fitted into socket 104 or 103 that normally holds exercise bar 20. The intraveneous attachment member includes a hook 145 for supporting an intravenous fluids bag 146 that has conventional intravenous tubes 147 extending therefrom.

Figure 6:
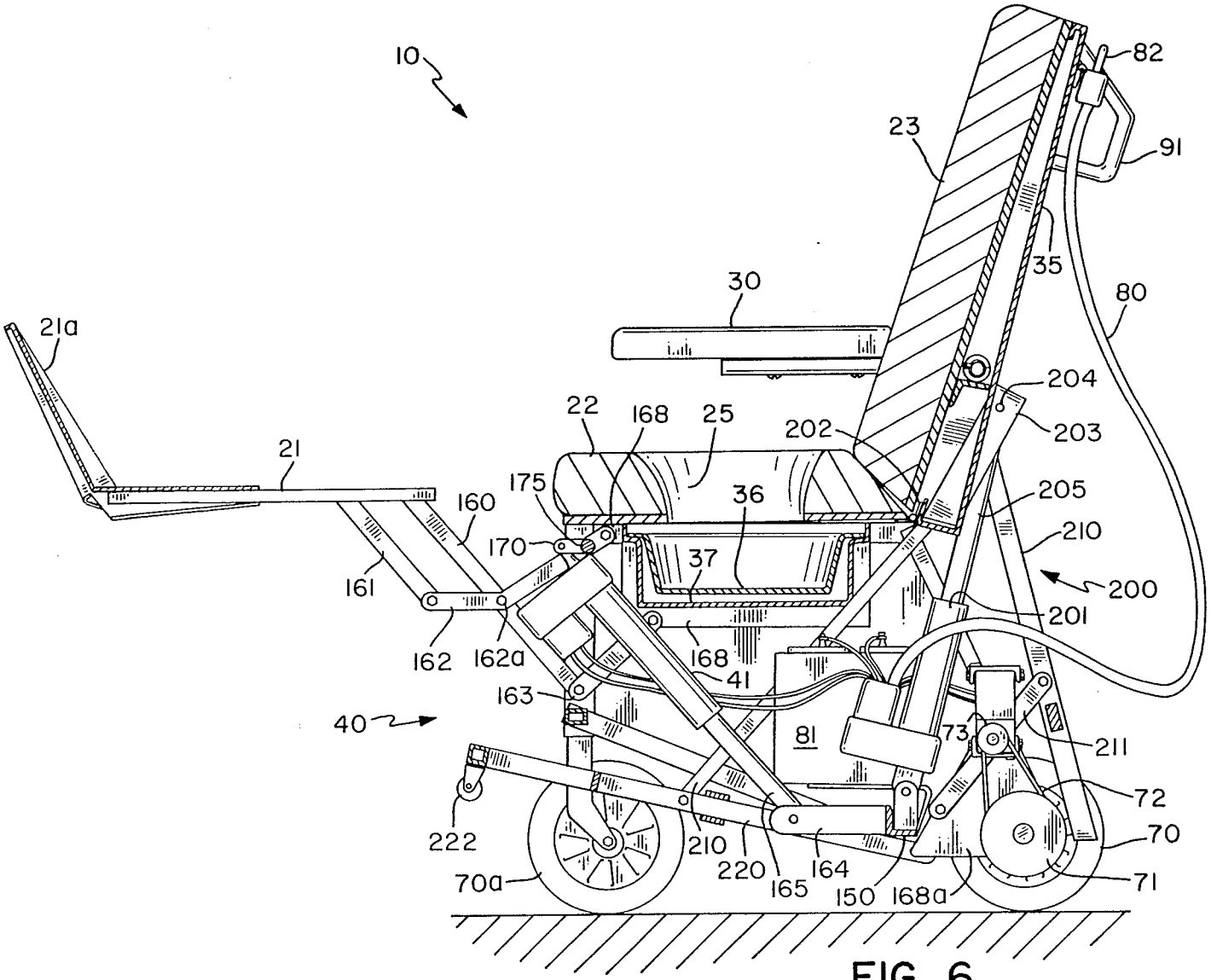
FIG. 6 shows a sectional view taken along lines 6—6 of FIG. 5.

In order to understand the operation and mechanisms for position my wheelchair in the chair position or the gurney position reference should be made to FIG. 6 which shows wheelchair 10 in cross section. Leg rest elevating mechanism includes scissor like members that extend on both sides of the wheelchair. FIG. 6 only shows the mechanism on one side of wheelchair 10. The legrest mechanism as shown in FIG. 6 shows that the legrest elevating mechanism extends and elevates legrest 21.

Legrest elevating mechanism includes a right side linkage and a leftside linkage. Right side linkage includes a first link 160 pivotably connected to the right side of legrest 21 and also pivotably connected to link 163 which is pivotably connected to the right side of frame 168. A second link 161 located parallel to link 160 has one end pivotally connects to legrest 21. The other end of link 161 pivotably connects to an angled link 162 that also pivotably connects to frame 168. Angled link 162 is also pivotably connected to link 160 at junction **162*a*. An identical linkage mechanism connects the left side of legrest 21 to the leftside of frame 168**. Since the right side linkage and the left side linkage are identical the operation of only the right side will be described.

To provide the means for raising and lowering the legrest 21 I utilize a linear actuator 41 that is powered by battery 81. A linear actuator 41 poweable by battery 81. The actuator 81 permits the user to raise and extend legrest 21 using the power from electrical storage battery 81. That is one end of linear actuator 41 contains an extendible and retractable rod 165 that pivotally connects to member 164. Member 164 rigidly connects to a cross bar 165 that connects to one side of frame 168. The other end of actuator 41 connects to a link 170 that connects to a partially rotational cross bar 175 that has one end connected to member 162 and the other connected to its counterpart on the opposite of wheelchair 10.

Referring to FIG. 6 and FIG. 7 the action of the elevation of legrest 21 can be observed. FIG. 7 illustrates the legrest elevation mechanism 40 and backrest pivoting mechanism 200.

A power is applied to actuator 41 to extend rod 165 outward it produces a lifting action on link 162 through link 170 and cross bar 175. Consequently, the extension of rod 165 pivotably raises and extends legrest 21 as shown in FIG. 6. The retraction of rod 21 causes legrest 21 to be returned to the vertical position as shown in FIG. 1. As evident from FIG. 6 and FIG. 7 the elevation of legrest 21 from the vertical position to the horizontal positon is performed independently of any other motion of the wheelchair. Thus the wheelchair user can adjust the position of legrest 21 to suit the preferences of the user.

The backrest pivoting mechanism 200 for raising and lowering backrest cushion 23 and for simultaneously raising or lowering wheelchair 10 can best be observed in FIG. 3, FIG. 6, and FIG. 7. The mechanism 200 for raising and lowering backrest cushion 23 and for simultaneously raising and lowering wheelchair 10 includes a further set of pivotably linkages that are driven by a second linear actuator 201 that is powered by electric storage battery 81.

Since the pivotably linkage is the same on both the right side and the left side of the wheelchair only one set of linkages and the linkage operation will be described.

FIG. 6 shows a hinge 202 pivotably connecting backrest frame 35 to frame 168. FIG. 2, FIG. 3, and FIG. 6 show the linkage for raising and lowering the backrest cushion 23 as well as elevating and lowering the entire wheelchair 10. FIG. 2 shows wheelchair 10 in the position with backrest cushion 23 substantially vertical and the lifting legs off the floor. FIG. 3 shows how the wheelchair 10 has been converted to a horizontal bed or gurney that can be vertically raised or lowered to position a user at the proper height for transfer of the user to a bed or the like.

The linkage includes a member 203 located at the center of frame 35. A pivot pin 204 pivotably connects member 203 to extendable and retractable rod 205. Located pivotably connected to the right side of frame 35 is a leg 210 that is also pivotally connected to one end of a line 211. The opposite end of link 211 pivotably connects to frame portion 168*a*.

Also pivotably connected to frame 35 is one end of a link 221. The other end of link 221 pivotably connects about the midpoint of a pivotably leg 220. One end of pivotably leg 220 pivotably connects to frame 168 and the other end includes a roller 222 for engaging the floor.

The linear actuator 201 for raising or lowering wheel chair 10 can best be seen in FIG. 6 and FIG. 2. In FIG. 2 the wheelchair 10 is located on the floor with wheels 70 and 70*a* and similar wheels (not shown) supporting wheelchair 10. In order to lower backrest cushion 23 and raise wheelchair 10 the user activates linear actuator 201 through switch 83 (FIG. 1). As the linear actuator is activated rod 205 retracts thus pivoting backrest frame 35 downward. FIG. 3 illustrates the results of the retraction of rod 205. Note leg 210 engages the floor and wheels 222 on leg 220 also engage the floor with the wheelchair and the wheels suspended above the floor. Thus the pivoting action of backrest frame 35 causes the entire wheelchair to be lifted from the floor. The purpose of rollers 222 is to permit leg 220 to move up or down without having the legs scrape on the floor. That is, rear leg 210 engages the floor in a fixed position while roller 222 rolls along the floor as leg 220 is lowered into engagement with the floor. Thus my backrest pivoting mechanism 200 permits one to simultaneously raise wheel chair 10 while pivoting backrest frame 35 to the horizontal position. Thus one can simultaneously lower the backrest to the horizontal position while raising the entire unit with the user on it to a level that is the same as the bed. Once the user on the wheelchiar is at bed level he or she can be transferred onto the bed without having to lift the user.

Another feature of my invention is my positionable footrest 21*a*. A reference to FIG. 7 shows legrest frame 21 with the legrest pad 21*b* removed and the footrest 21*a* removed. The means for positioning my footrest at different positions are located on the bottom of legrest frame 21 and comprise a set of openings 21*d* that engage protruding members on the backside of footrest 21*a* so that footrest 21*a* can be positioned at different locations on frame 21 to thereby accommodate users who have shorter or longer legs.

I claim:

1. An all purpose wheelchair to permit a user to be self sufficient and to permit a user to move from a chair type support to a horizontal bed type support with the horizontal bed type support being vertically positionable comprising:

a frame;

a backrest for supporting the back of a person, said backrest pivotably connected to said frame;

a first set of extendable legs connected to said backrest;

a seat cushion located on said frame for supporting the posterior region of a person;

a legrest for supporting the legs of a person;

a backrest pivoting mechanism connected to said backrest;

a second set of extendable legs connected to said backrest and said frame;

a first power mechanism for pivoting said backrest from a horizontal to a vertical position or from a vertical to a horizontal position; and a source of power for activating said first power mechanism so that when the wheelchair is in the chair type support position the powering of said first mechanism causes said backrest to pivot from the vertical to the horizontal position and to extend said first set of legs and said second set of legs to form engagement with a support surface to permit the vertical raising of a user on said seat cushion and said backrest to thereby permit a user of the wheelchair to be positioned at the same level of a bed so the wheelchair user can be transferred from the wheelchair to the bed withoout anyone having to lift the wheelchair user.

2. The wheelchair of claim 1 including a legrest elevating mechanism connected to said legrest, said legrest pivotably and extendable connected to said frame to simultaneously raise and extend said leg rest to prevent the legrest from pushing on the feet of a user as the legrest is raised from a vertical to a horizontal position.

3. The wheelchair of claim 2 including a second power mechanism connected to said frame and said legrest elevating mechanism for pivoting said legrest from a vertical positional to a horizontal position or from a horizontal position to a vertical position.

4. The wheelchair of claim 3 including an opening in said seat cushion and a bedpan slideable mounted in said frame to permit a person to remove said bedpan by sliding said bedpan laterally out of said frame.

5. the wheelchair of claim 4 including a footrest on said legrest for supporting the feet of a user.

6. The wheelchair of claim 5 including sidearms that are pivotally mounted on said wheelchair to permit said sidearms to be pivoted out of the way to permit placing of the wheelchair flush with a bed so a user can be laterally transferred directly from said wheelchair to a bed.

7. The wheelchair of claim 6 wherein said wheelchair includes wheels, a control module for powering and controlling the motion of said wheelchair by a user sitting in said wheelchair.

8. The wheelchair of claim 7 wherein said backrest includes handgrips located on said backerest, said handgrips having one section located at a 45 degree angle to said backrest and a second section located parallel to said backrest so that a person assisting the wheelchair user can grasp the handgrip at either section.

9. The wheelchair of claim 8 wherein said legs include at least one set of legs with rollers on to permit one of the set of legs to remain in a stationary position while the other legs with rollers are permitted to move during the elevation of said wheelchair.

10. The wheelchair of claim 9 wherein said wheelchair includes an exercise bar attached to said wheelchair.

11. The wheelchair of claim 10 wherein said exercise bar includes positionable hand exercise members.

12. The invention of claim 9 wherein said wheelchair includes an intravenous fluids holder for permitting a person to receive intravenous fluids while in said wheelchair.

13. The wheelchair of claim 12 wherein said power source for said wheel chair includes a storage battery and a battery charger for recharging said battery.

14. The wheelchair of claim 13 wherein said first power mechanism and said second power mechanism comprise linear actuators.

15. The wheelchair of claim 14 wherein said footrest includes means for positioning said footrest on said wheelchair to accommodate persons of different leg lengths.

16. The wheelchair of claim 15 wherein said wheelchair includes a control module for said wheelchair that is connected to a umbilical cord that can be attached to said backrest or to one of the sidearms of said wheelchair.

17. The wheelchair of claim 16 wherein said frame includes a compartment located below said bedpan to catch any spillage from said bedpan.

18. An all purpose wheelchair to permit a user to be self sufficient and to permit a user to move from a seating position to a horizontal position with the wheelchair being vertically positionable comprising:

a frame;

a backrest for supporting the back of a person at various postions, said backrest pivotably connected to said frame;

a first set of extendable legs connected to said backrest;

a seat cushion located on said frame for supporting the posterior region of a person, said seat cushion having an opening therein to permit placement of a bedpan below the opening in said cushion;

a backrest pivoting mechanism connected to said backrest;

a second set of extendable legs connected to said backrest and said frame;

a power mechanism for pivoting said backrest from a horizontal to a vertical position or from a vertical to a horizontal position and for simultaneously extending or contracting said legs;

a control module to permit a user located in the wheelchair to control said power mechanism; and a source of power, said source of power controllable by said control module so that when the wheelchair is in the position to support a user in a sitting position the powering of said backrest pivoting mechanism causes said backrest to pivot from a vertical to a horizontal position and to simultaneous extend said first set of legs and said second set of legs to form engagement with a support surface to thereby elevate a user on said seat cushion so that a user of the wheelchair can be positioned at the same level of a bed to facilitate transfer of the wheelchair user from the wheelchair to a bed.

* * * * *